US008939601B1

(12) United States Patent
Lee

(10) Patent No.: US 8,939,601 B1
(45) Date of Patent: Jan. 27, 2015

(54) COLLAPSIBLE CAMPING LANTERN

(71) Applicant: Wen-Sung Lee, Taichung (TW)

(72) Inventor: Wen-Sung Lee, Taichung (TW)

( * ) Notice: Subject to any disclaimer, the term of this patent is extended or adjusted under 35 U.S.C. 154(b) by 48 days.

(21) Appl. No.: 13/935,464

(22) Filed: Jul. 3, 2013

(51) Int. Cl.

| | |
|---|---|
| ***F21V 1/06*** | (2006.01) |
| ***F21V 19/02*** | (2006.01) |
| ***F21K 99/00*** | (2010.01) |
| ***F21L 4/00*** | (2006.01) |

(52) U.S. Cl.
CPC . *F21V 19/02* (2013.01); *F21K 9/50* (2013.01); *F21L 4/00* (2013.01)
USPC ..... 362/162; 362/198; 362/203

(58) Field of Classification Search
CPC . F21V 29/22; F21V 29/2206; F21V 29/2268; F21V 1/06
USPC ..... 362/198, 186, 162, 203
See application file for complete search history.

(56) References Cited

U.S. PATENT DOCUMENTS

| | | | | |
|---|---|---|---|---|
| 2,420,772 | A * | 5/1947 | Dalton | 343/720 |
| 4,646,213 | A * | 2/1987 | Fanelli et al. | 362/180 |
| 5,424,928 | A | 6/1995 | Jordan et al. | |
| 5,687,874 | A * | 11/1997 | Omori et al. | 220/737 |
| 6,030,094 | A * | 2/2000 | Sedovic et al. | 362/203 |
| 6,305,820 | B1 * | 10/2001 | Poon | 362/186 |
| 7,857,481 | B2 * | 12/2010 | Oh et al. | 362/202 |
| 8,419,207 | B2 * | 4/2013 | Smith | 362/199 |
| 2008/0037265 | A1 * | 2/2008 | Hsu | 362/388 |
| 2013/0250564 | A1 * | 9/2013 | Lau | 362/186 |

* cited by examiner

*Primary Examiner* — Anh Mai
*Assistant Examiner* — Matthew J Peerce

(57) ABSTRACT

A collapsible lantern includes a base, an inner telescopic portion, an outer telescopic portion and a switch. The inner telescopic portion is movable relative to the base between a first, collapsed position and a second, raised position. The inner telescopic portion includes a light source and a power source. The outer telescopic portion includes a cap and is movable relative to the inner telescopic portion and the base between a first, collapsed position where the light source is covered by the cap and a second, raised position where the cap is spaced above the light source. Moreover, the outer telescopic portion is movable together with the inner telescopic portion, relative to the base, from the second position to a third, uppermost position. The switch is electrically connected between the light source and the power source and arranged to be off until the outer telescopic portion reaches the third position.

8 Claims, 12 Drawing Sheets

COLLAPSIBLE CAMPING LANTERN

BACKGROUND OF THE INVENTION

1. Field of the Invention The present invention relates to a camping lantern and more particularly to a collapsible camping lantern in which a light source, which is movable between extended and collapsed positions, is automatically electrically connected to a power source, by a switch, as the light source moves from the collapsed position to the extended position.

2. Description of the Related Art

Collapsible lanterns, which have been provided in the past, generally include a candle or wick, which provides a flame as a light source. The candle or wick is mounted in a base, and a transparent globe is telescopically mounted in the base. An example of such candle lantern is described in U.S. Pat. No. 5,424,928.

Another type of collapsible lantern is shown in U.S. Pat. No. 6,030,094, which provides an electrically powered collapsible lantern in which a light source, which is movable between extended and collapsed positions, is automatically electrically disconnected from a power source, by a switch, as the light source moves from the extended position to the fully collapsed position.

SUMMARY OF THE INVENTION

It is an objective of the present invention to provide a new type of a camping lantern that is collapsible and employs a light emitting diode (LED) as its light source. In particular, the light source, which is movable between extended and collapsed positions, is automatically electrically connected to a power source, by a switch, as the light source moves from the collapsed position to the fully extended position. And, while not in use, the lantern can be stored in the compact, collapsed configuration.

To achieve the foregoing objective, the collapsible camping lantern generally includes a base, an inner telescopic portion, an outer telescopic portion and a switch. The inner telescopic portion includes a light source and a power source and is movable, relative to the base, between a first, collapsed position and a second, raised position. The outer telescopic portion includes a cap and is movable, relative to the inner telescopic portion and the base, between a first, collapsed position where the light source is covered by the cap and a second, raised position where the cap is spaced above the light source. Moreover, the outer telescopic portion is movable together with the inner telescopic portion, relative to the base, from the second position to a third, uppermost position. The switch is electrically connected between the light source and the power source. And, the switch is arranged to be off until the outer telescopic portion reaches the third position.

Preferably, the outer telescopic portion further comprises a shade frame mounted to a bottom of the cap. When the outer telescopic portion is in the first position, the shade frame encloses the base in which the inner telescopic portion is housed. And, the shade frame holds the inner telescopic portion while the outer telescopic portion is in the second position in order to raise the inner telescopic portion from the first position up to the second position.

Preferably, a magnet is employed and mounted on the base and the switch is a reed switch mounted on the inner telescopic portion. In this manner, when the outer telescopic portion reaches the third, topmost position where the inner telescopic portion is in the second, raised position, the switch comes to be in close proximity to the magnet to turn the switch on.

Further benefits and advantages of the present invention will become apparent after a careful reading of the detailed description with appropriate reference to the accompanying drawings.

BRIEF DESCRIPTION OF THE DRAWINGS

A collapsible camping lantern according to the invention will now be described, by way of example, with reference to the accompanying drawings, in which.

DETAILED DESCRIPTION OF EMBODIMENTS

Figure 1:
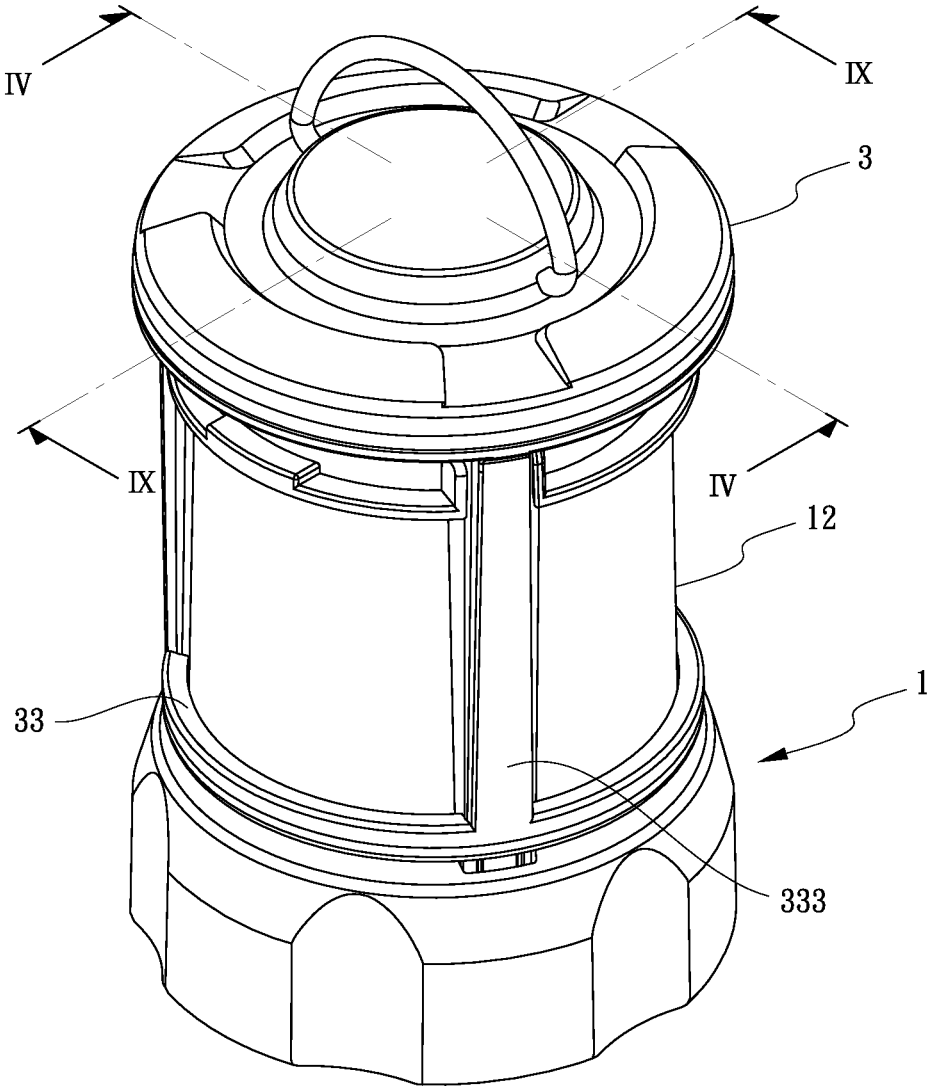
FIG. 1 is an isometric view of the collapsible camping lantern.
Figure 2:
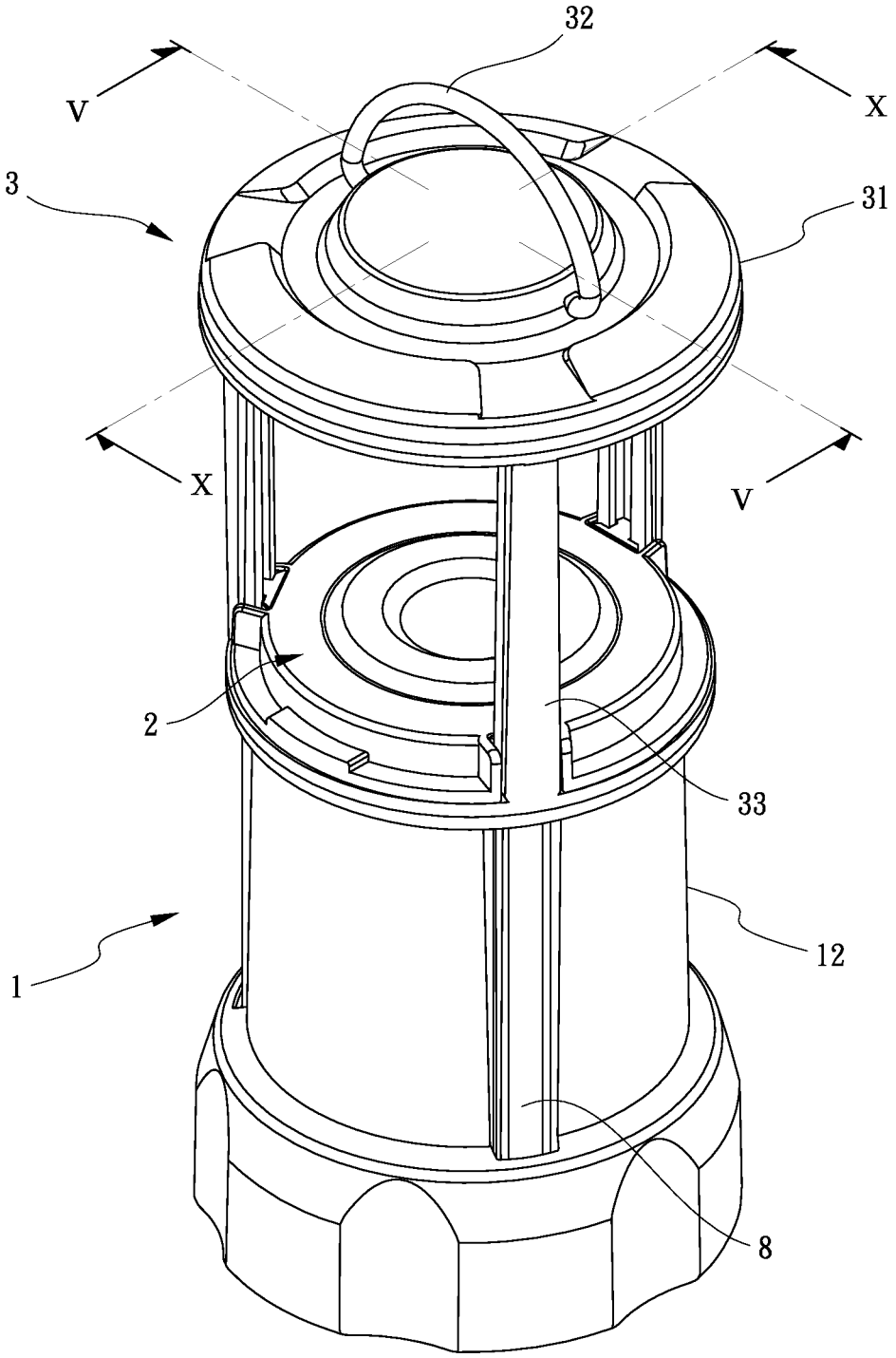
FIG. 2 is another isometric view of the collapsible camping lantern, showing that lantern is partly extended.
Figure 3:
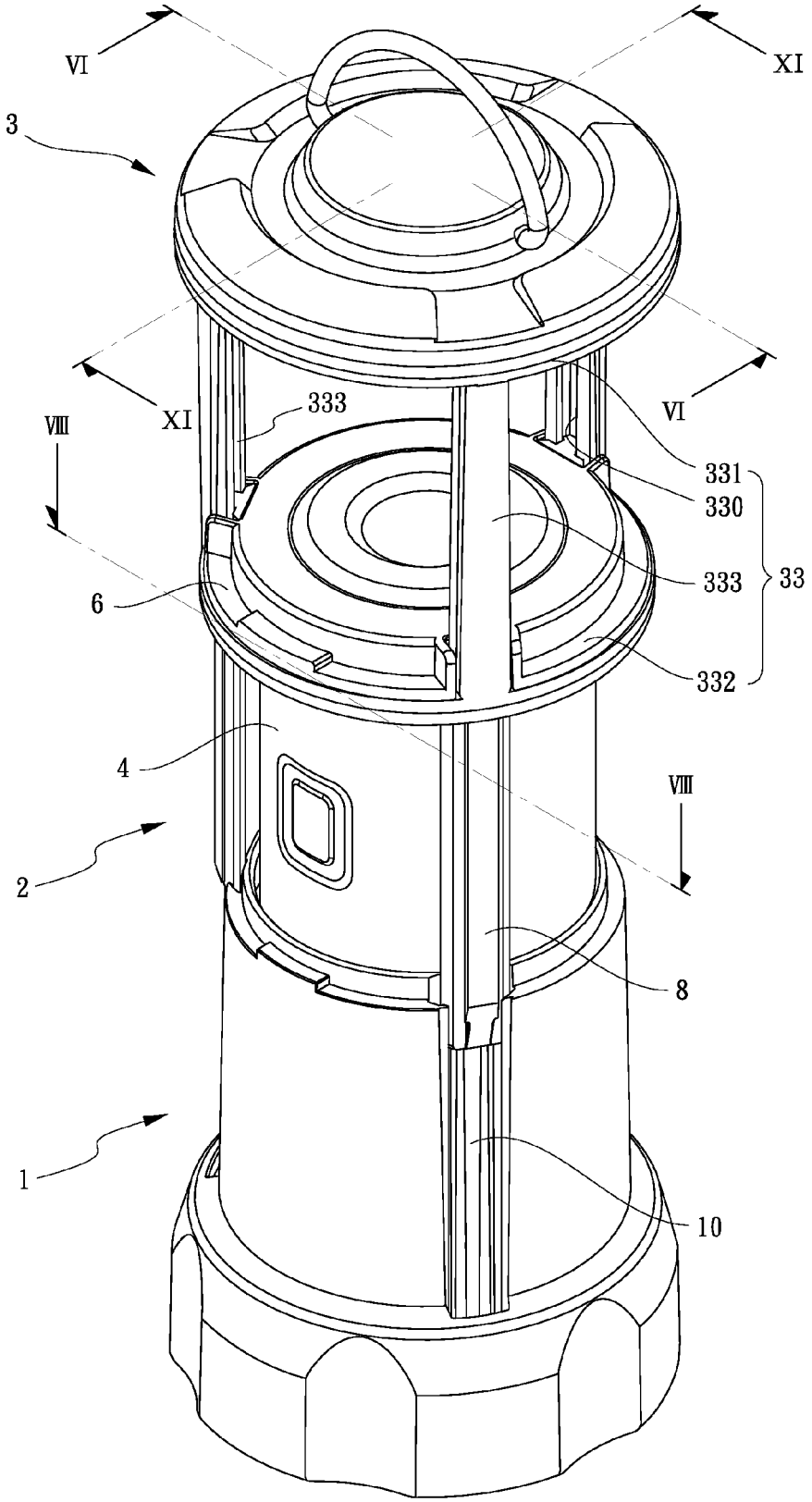
FIG. 3 is yet another isometric view of the collapsible camping lantern, showing that lantern is fully extended.

FIGS. 1-3 illustrate a collapsible camping lantern which includes a base 1, an inner telescopic portion 2 and an outer telescopic portion 3. In general, the outer telescopic portion 3 may be raised up, relative to the inner telescopic portion 2 and the base 1, from a first, collapsed position, as depicted in FIG. 1, to a second, raised position, as depicted in FIG. 2. Afterward, the outer telescopic portion 3 may further be raised together with the inner telescopic portion 2, relative to the base 1, from the second position to a third, uppermost position, as depicted in FIG. 3. However, the inner telescopic portion 2 is movable, relative to the base I, between a first, collapsed position (FIG. 1 or 2) and a second, raised position (see FIG. 3) only.

Figure 4:
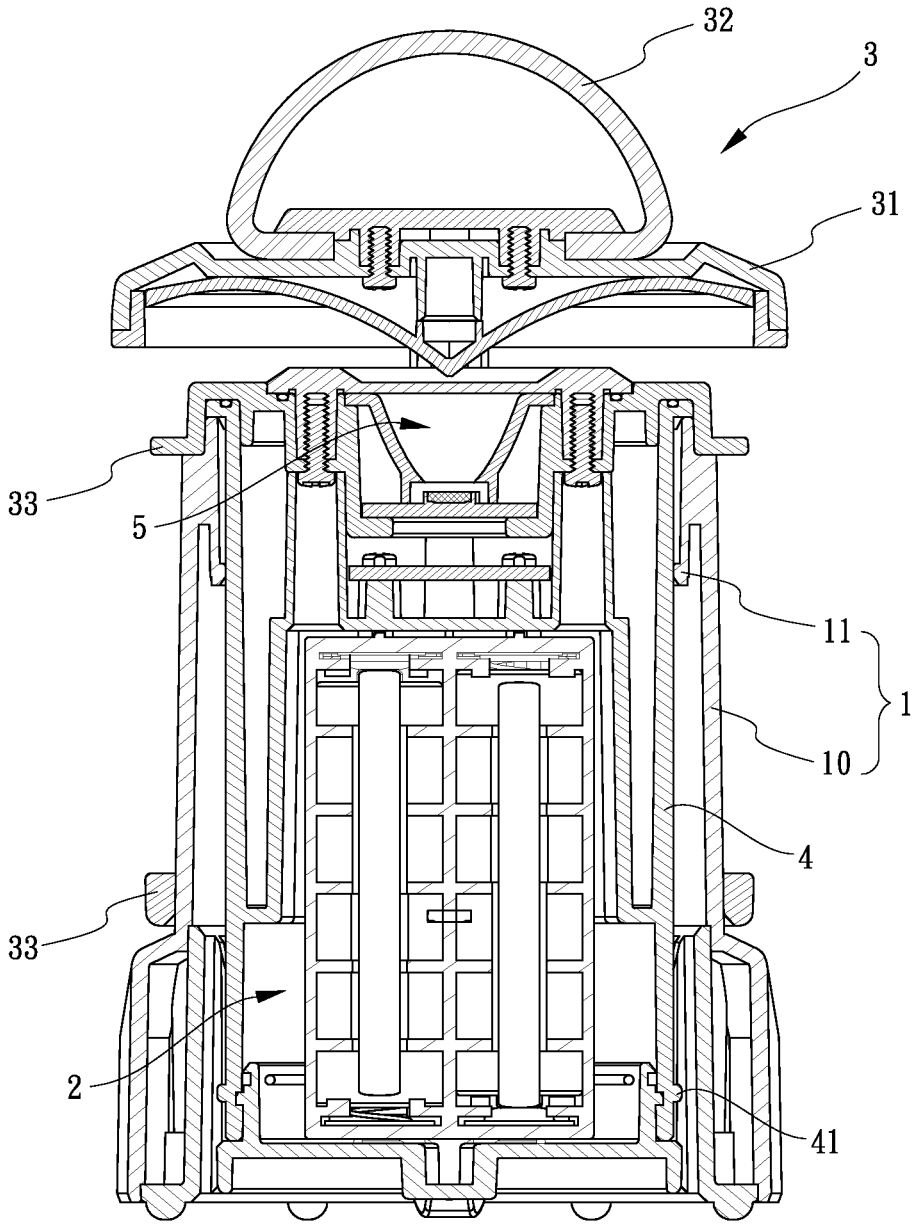
FIG. 4 is a cross section of the collapsible camping lantern taken along the line IV-IV of FIG. 1.
Figure 5:
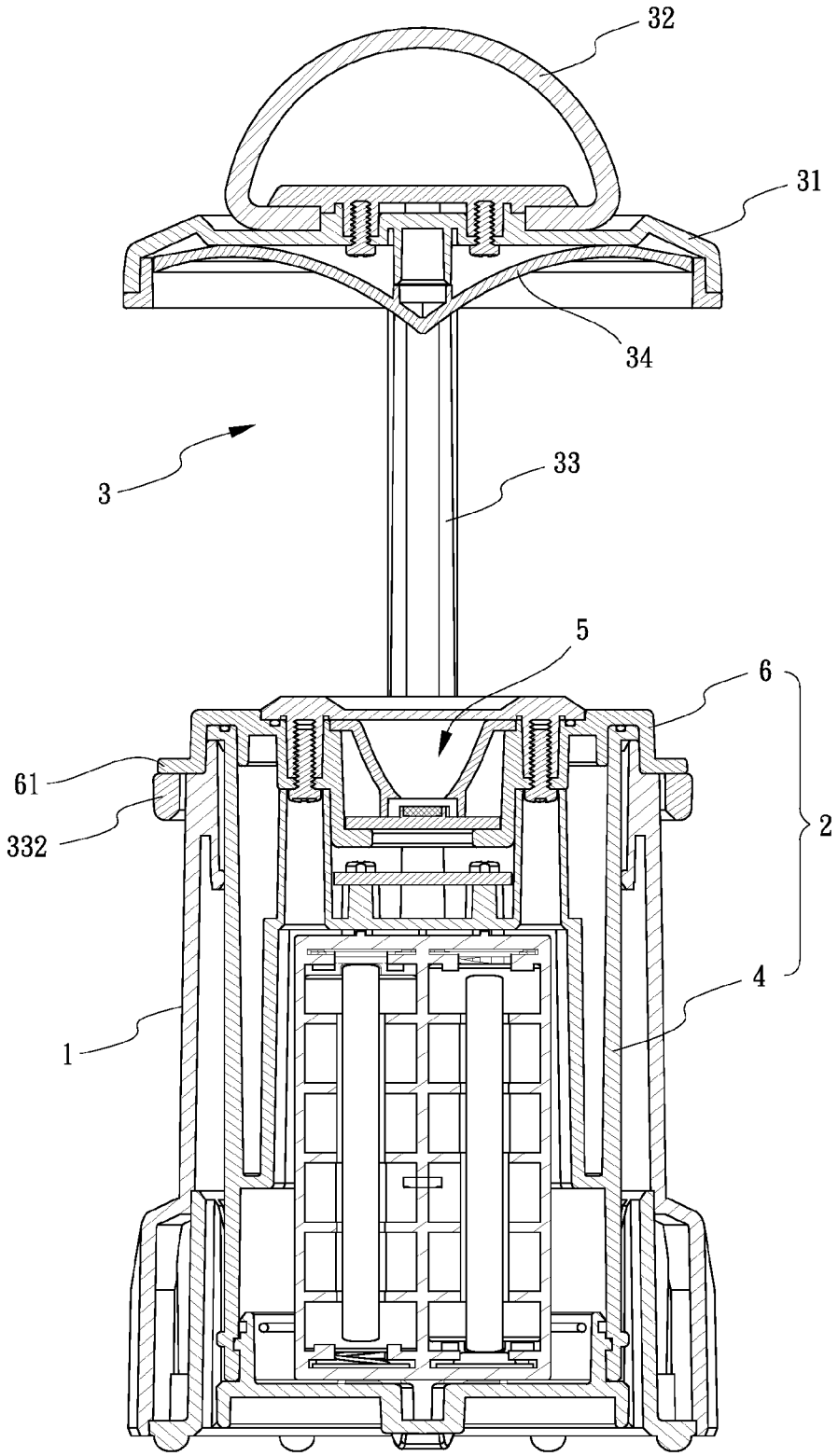
FIG. 5 is a cross section of the collapsible camping lantern taken along the line V-V of FIG. 2.

As shown in FIG. 4 and referring to FIG. 1, the base 1 is generally cylindrical in shape and has a peripheral wall 12 and an elastic hook 11 extending from an upper, inner surface of the peripheral wall 12. As shown in FIG. 5 and referring to FIG. 2, the outer telescopic portion 3 includes a cap 31, a bail 32 secured to a top surface of the cap 31, a shade frame 33 secured to a bottom of the cap 31, and a reflector 34 attached to the bottom of the cap 31.

Figure 6:
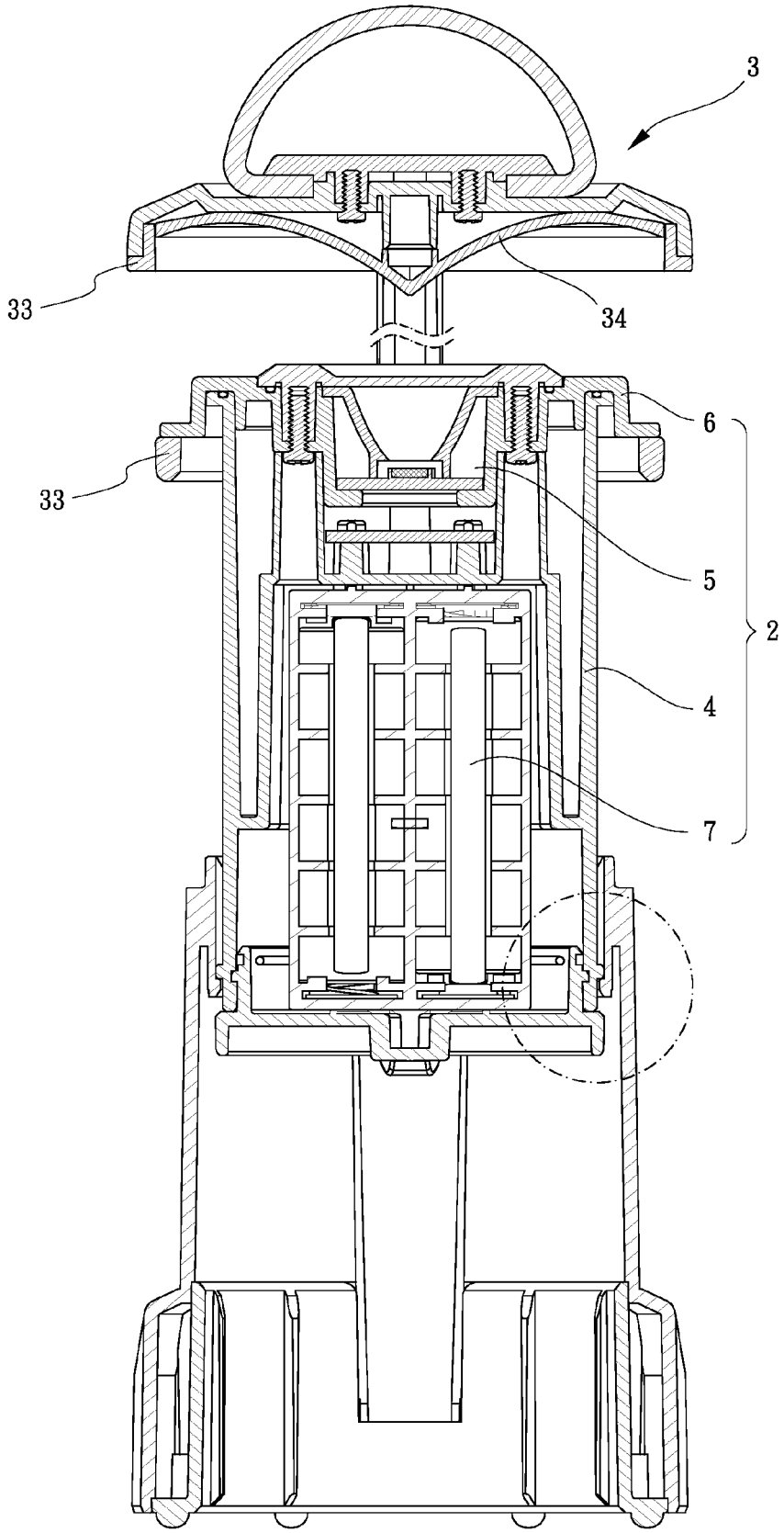
FIG. 6 is a cross section of the collapsible camping lantern taken along the line VI-VI of FIG. 3.

As shown in FIG. 6 and referring to FIG. 3, the inner telescopic portion 2 includes an inner casing 4, a light source 5 disposed in an upper compartment of the inner casing 4, a heat dissipating plate 6 fixed on top of the inner casing 4 and in which the light source 5 is mounted, and a power source 7 disposed in a lower compartment of the inner casing 4. The reflector 34 of the outer telescopic portion 3 is confronted with the light source 5 so as to direct light emitted from the light source 5 laterally out of the collapsible camping lantern.

FIG. 4 illustrates that the outer telescopic portion 3 is in its first, collapsed position; and the inner telescopic portion 2 is in its first, collapsed position. At this time, the light source 5 is covered by the cap 31. The shade frame 33 of the outer telescopic portion 3 encloses the base 1 in which the inner telescopic portion 2 is housed. The inner casing 4 of the inner telescopic portion 2 is formed with at least one protrusion 41 on a lower, outer surface thereof.

When the outer telescopic portion 3 is in the second, raised position, the cap 31 is spaced above the light source 5, as shown in FIG. 5, and the inner telescopic portion 2 remains in its first, collapsed position. At this time, a switch 90 (see FIG. 9), which is electrically connected between the light source 5 and the power source 7, remains in an OFF state such that the light source 5 does not shine. It is until the outer telescopic portion 3 moves to the third, uppermost position, as shown in FIG. 6 that the switch 90 is turned in an On state to have the light source 5 be powered by the power source 7 and shine, as will be discussed in detail later.

Figure 7:
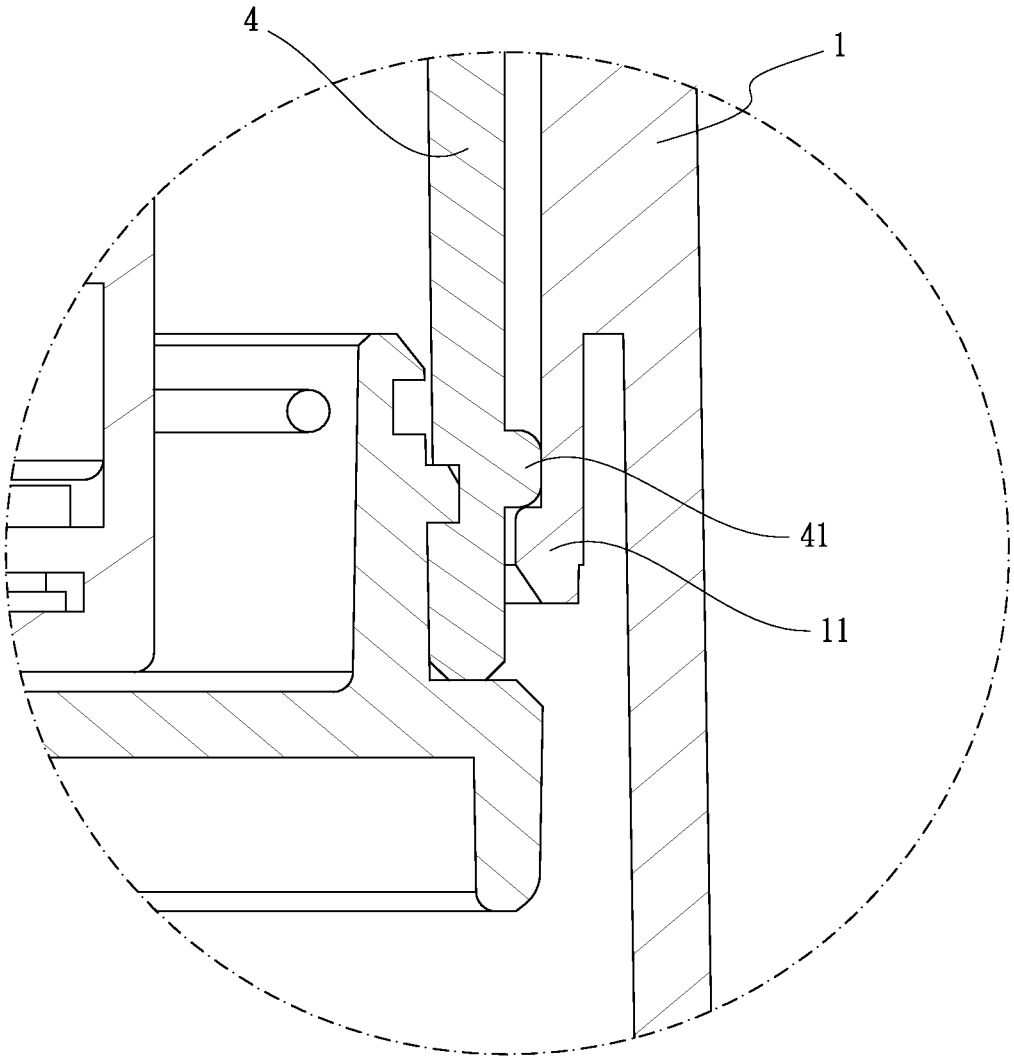
FIG. 7 is an enlarged fragmentary sectional view of the collapsible camping lantern taken from FIG. 6.

As shown in FIG. 6, when the outer telescopic portion 3 reaches its third, uppermost position, the inner telescopic portion 2 reaches its second, raised position. At this time, the protrusion 41 of the inner casing 4 is engaged with the elastic hook 11 of the base 1, as best shown in FIG. 7.

Figure 9:
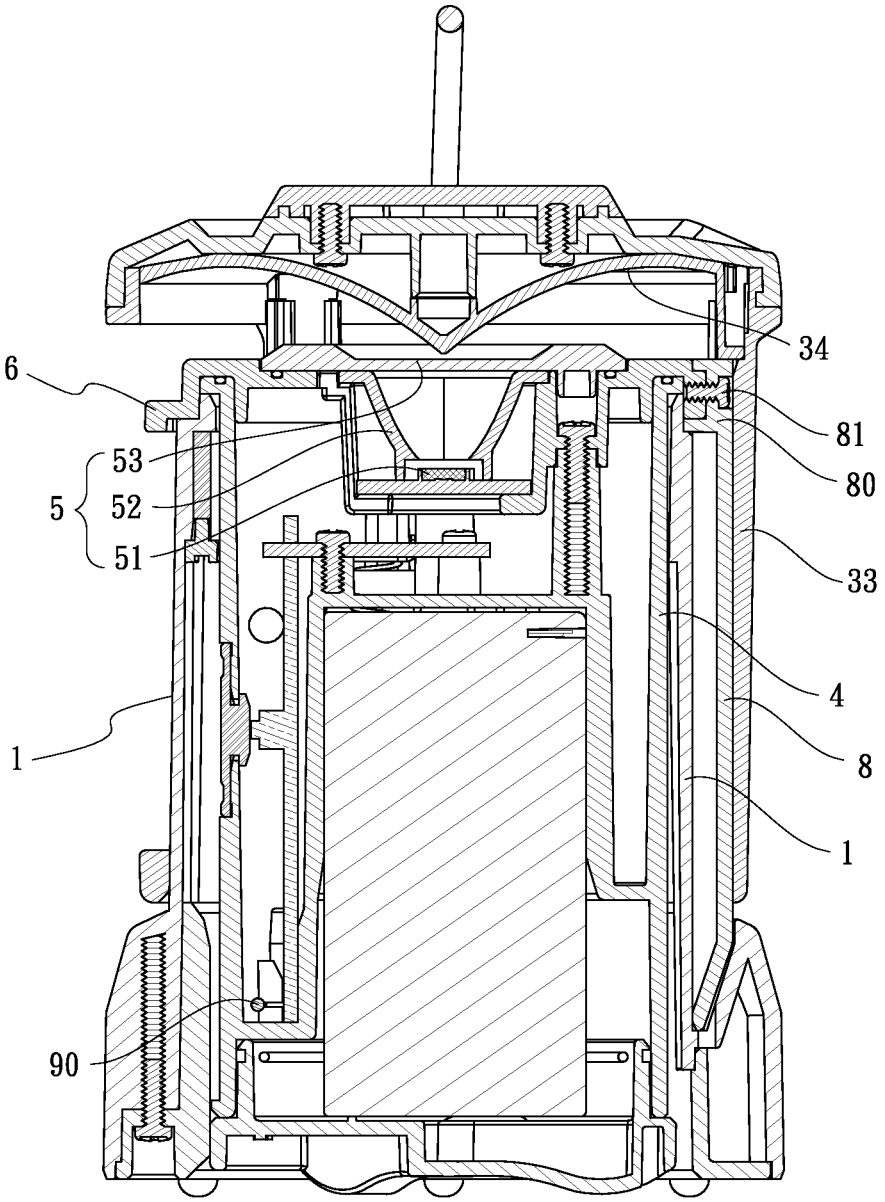
FIG. 9 is a cross section of the collapsible camping lantern taken along the line IX-IX of FIG. 1.

Specifically, as best seen in FIG. 3, the shade frame 33 includes an upper ring 331, a lower ring 332 in parallel with the upper ring 331, and a plurality of pillars 333 arranged to connect the upper ring 331 and the lower ring 332. The inner telescopic portion 2 further includes a plurality of guiding bars 8 secured to the inner casing 4 and corresponding to the pillars 333 of the shade frame 33 such that the pillars 333 are movable along the respective guiding bars 8. Referring to FIG. 9, each of the guiding bars 8 of the inner telescopic portion 2 has a top end 80 secured, by a screw 81, with the heat dissipating plate 6 which is fixed to an upper edge of the inner casing 4. Moreover, each guiding bar 8 is partly, slidably located within a respective guide groove 10 (see FIG. 3) defined in an outer surface of the base 1 when the inner telescopic portion is in the first position, as shown in FIGS. 1 and 2.

Figure 8:
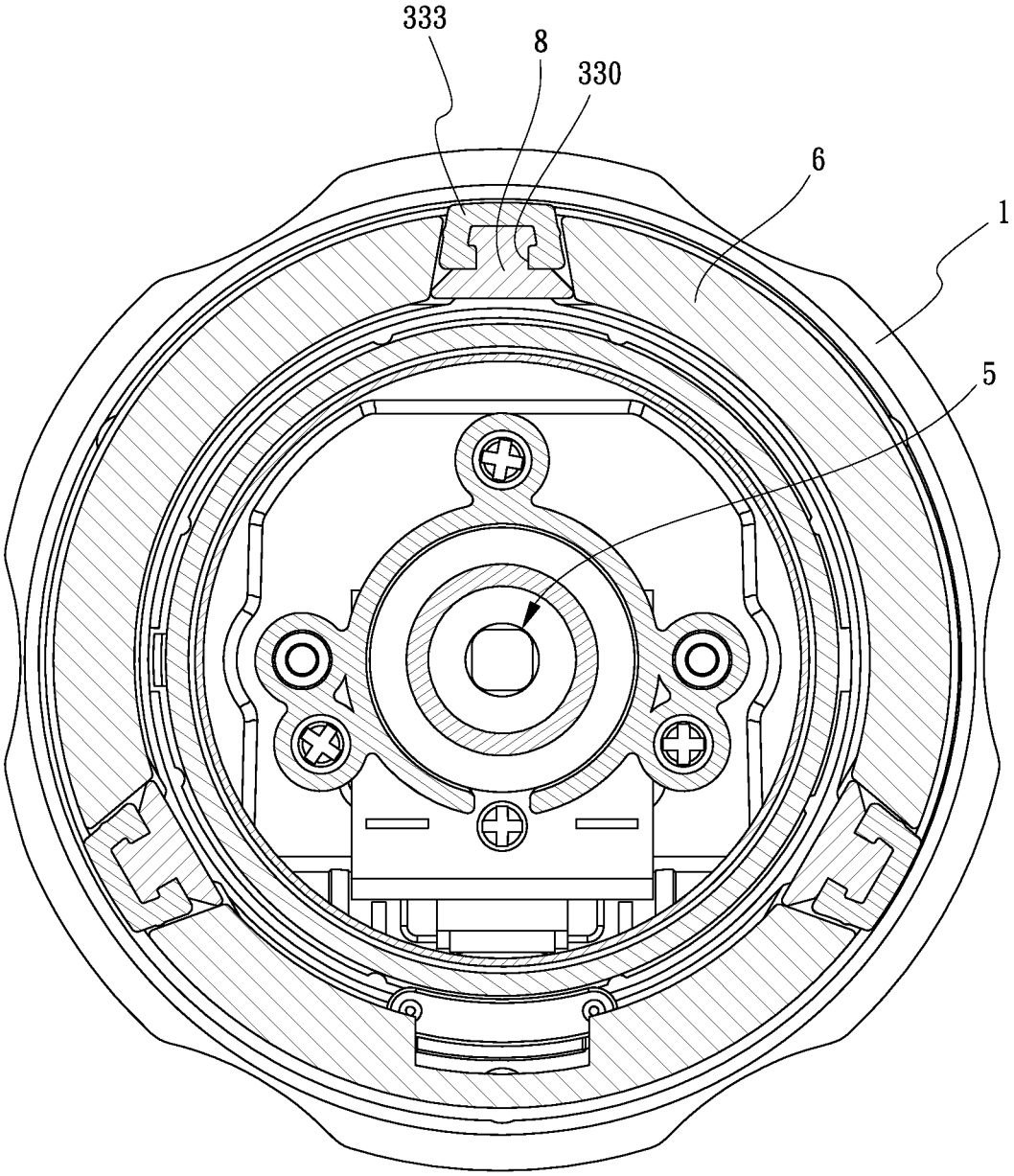
FIG. 8 is a cross section of the collapsible camping lantern taken along the line VIII-VIII of FIG. 3.

Referring again to FIG. 3, each of the pillars 333 of the shade frame 33 defines a recessed track 330 in an inner side thereof Each of the guiding bars 8 of the inner telescopic portion 2 is partly, closely fitted within a respective one of the recessed tracks 330 of the pillars 333, as depicted in FIG. 8, to releasably maintain the outer telescopic portion 3 in either one of the second and the third positions.

Referring to FIGS. 5 and 6, the shade frame 33 of the outer telescopic portion 3 holds the inner telescopic portion 2 while the outer telescopic portion 3 is in the second position. That is, the lower ring 332 of the shade frame 33 is situated below a radially enlarged shoulder 61 of the heat dissipating plate 6 and abut against the shoulder 61. Thus, when the outer telescopic portion 3 moves from the second position to the third position, the outer telescopic portion 3 may raise the inner telescopic portion 2 from the first position (FIG. 5) up to the second position (FIG. 6) with the shade frame 33. Furthermore, the shoulder 61 limits upward movement of the outer telescopic portion 3 when the outer telescopic portion 3 reaches its third, uppermost position.

Referring to FIG. 9, the light source 5 includes a light emitting diode chip 51 and a reflective cup 52 mounted above the light emitting diode 51 to direct light emitted from the light emitting diode chip 51 toward the reflector 34 of the outer telescopic portion 3 which is spaced above the reflective cup 52. Moreover, a transparent protective lid 53 may be included in the light source 5 to cover a top opening of the reflective cup 52. Moreover, the heat dissipating plate 6 has legs extending to a bottom of the light emitting diode chip 51 for dissipating heat generated by the light emitting diode chip 51.

Figure 10:
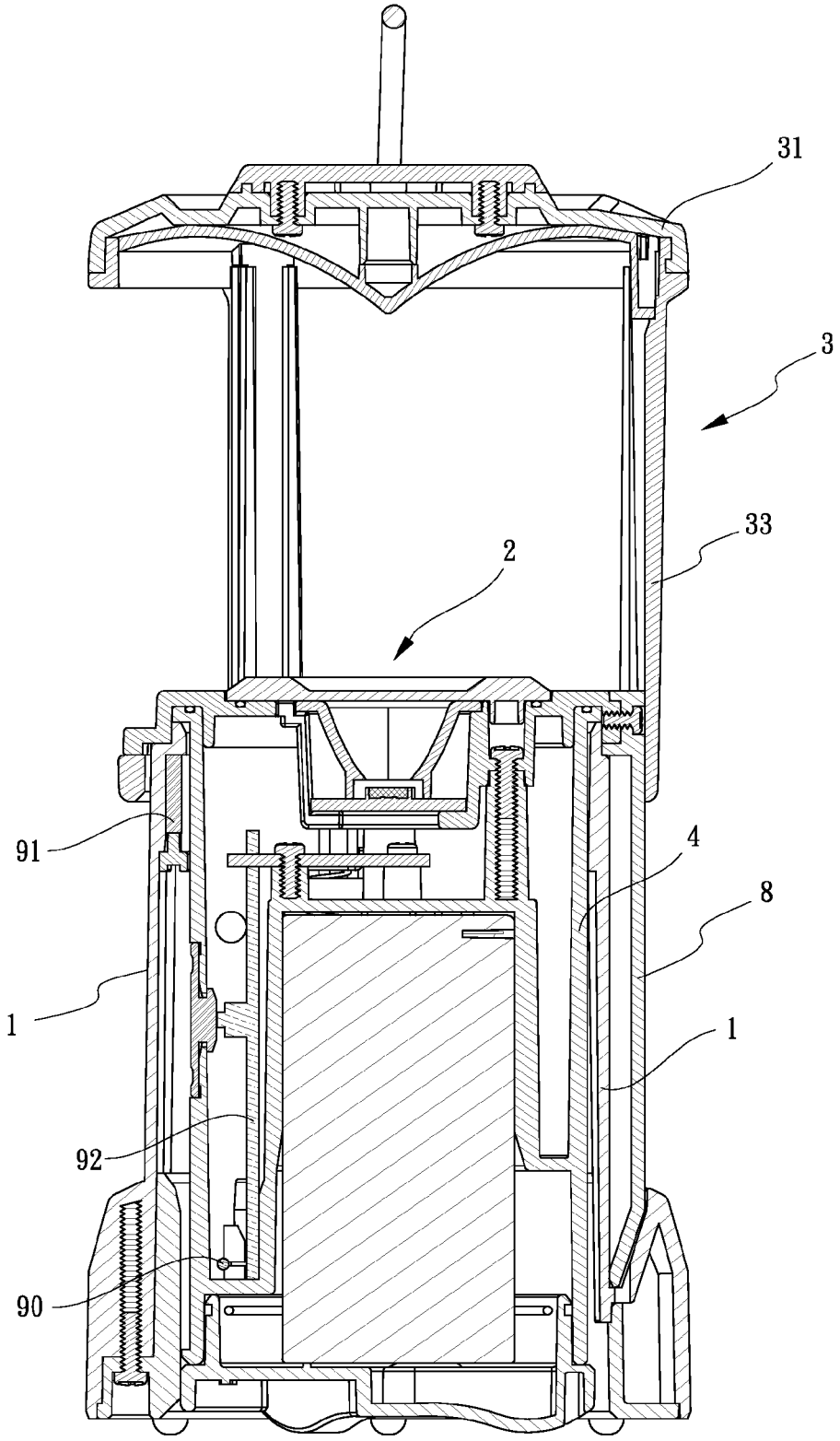
FIG. 10 is a cross section of the collapsible camping lantern taken along the line X-X of FIG. 2.
Figure 11:
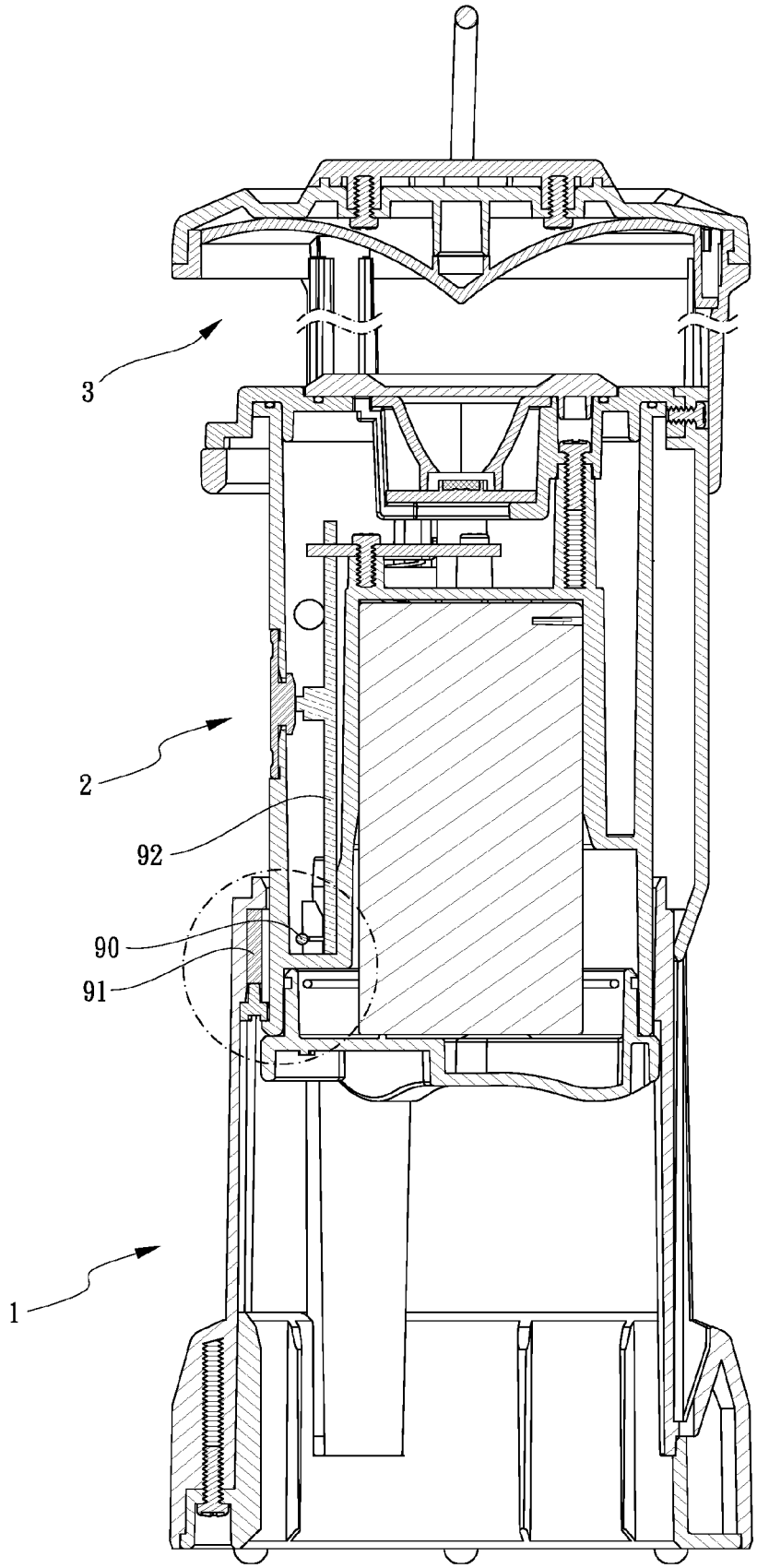
FIG. 11 is a cross section of the collapsible camping lantern taken along the line XI-XI of FIG. 3.
Figure 12:
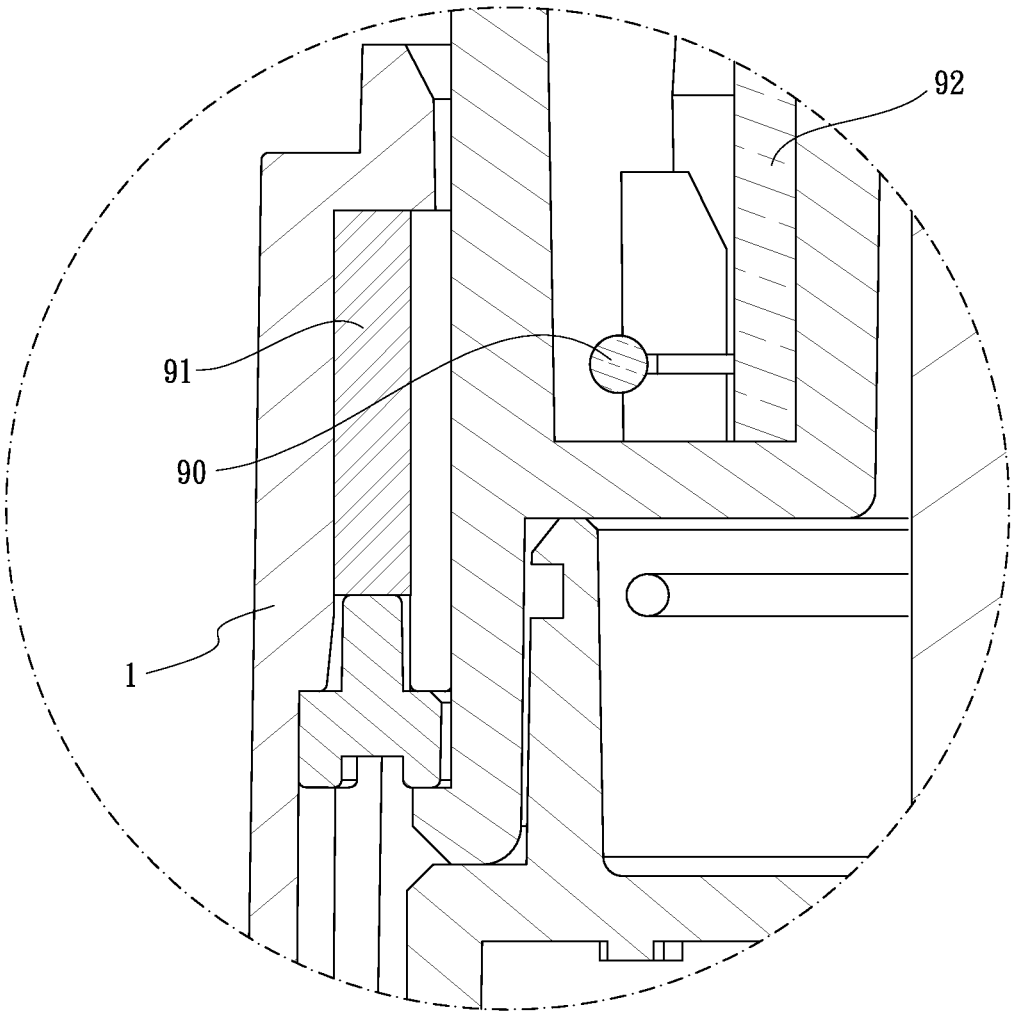
FIG. 12 is an enlarged fragmentary sectional view of the collapsible camping lantern taken from FIG. 11.

In this embodiment, a magnet 91 is employed and mounted on an inner side of the base 1, as shown in FIG. 10. The switch 90 is a reed switch mounted on a printed circuit board 92 of the inner telescopic portion 2 as such that when the outer telescopic portion 3 reaches the third, topmost position, as shown in FIG. 11, where the inner telescopic portion 2 is in the second, raised position, the switch 90 comes to be in close proximity to the magnet 91 to turn the switch on. Thus, the light source 5 is powered by the power source 7 for illumination. In other words, the switch 90 is off until the outer telescopic portion 3 reaches the third position, light from the light source 5 shines through the shade frame 33 and reflected by the reflector 34 toward outside of the camping lantern. When the lantern is not being used, the lantern can be stored in the compact, collapsed configuration illustrated in FIG. 1 by telescoping the inner and outer telescopic portions 2, 3 into the base 1.

It is to be understood that the disclosed embodiments are illustrative in nature and the invention is not to be limited to any one or more embodiments except as set forth in the following claims.

What is claimed is:

1. A collapsible lantern, comprising:

a base;

an inner telescopic portion movable, relative to the base, between a first, collapsed position and a second, raised position; the inner telescopic portion including a light source and a power source;

an outer telescopic portion including a cap and movable, relative to the inner telescopic portion and the base, between a first, collapsed position where the light source is covered by the cap and a second, raised position where the cap is spaced above the light source; and the outer telescopic portion further movable together with the inner telescopic portion, relative to the base, from the second position to a third, uppermost position; and a switch electrically connected between the light source and the power source; wherein the switch is off until the outer telescopic portion reaches the third position;

wherein the outer telescopic portion further comprises a shade frame mounted to a bottom of the cap; when the outer telescopic portion is in the first position, the shade frame encloses the base in which the inner telesco portion is housed; and when the outer telescopic portion is in the second position, the shade frame holds the inner telescopic portion in order to raise the inner telescopic portion from the first position up to the second position; and wherein the shade frame includes an upper ring, a lower ring in parallel with the upper ring, and a plurality of pillars arranged to connect the upper ring and the lower ring; the inner telescopic portion further includes an inner casing in which the light source and the power source are disposed, and a plurality of guiding bars secured to the inner casing and corresponding to the pillars of the shade frame such that the pillars are movable along the respective guiding bars.

2. The collapsible lantern of claim 1, wherein the base defines a plurality of guide grooves each formed in an axial direction in an outer surface thereof; each of the guiding bars of the inner telescopic portion has a top end secured to an upper edge of the inner casing and is partly, slidably located within a respective one of the guide grooves of the base when the inner telescopic portion is in the first position.

3. The collapsible lantern of claim 2, wherein each of the pillars of the shade frame of the outer telescopic portion defines a recessed track in an inner side thereof; and each of the guiding bars of the inner telescopic portion is partly, closely fitted within a respective one of the recessed tracks of the pillars to releasably maintain the outer telescopic portion in either one of the second and the third positions.

4. The collapsible lantern of claim 1, wherein the inner telescopic portion further includes a heat dissipating plate fixed on top of the inner casing and in which the light source is mounted; and the lower ring of the shade frame is disposed below a radially enlarged shoulder of the heat dissipating plate so as to abut against the shoulder when the outer telescopic portion is in the second position.

5. The collapsible lantern of claim 1, wherein the inner casing is formed with at least one protrusion on a lower, outer surface thereof;

the base has a peripheral wall and a hook extending from an upper, inner surface of the peripheral wall so that the protrusion of the inner casing is engaged with the hook of the base when the inner telescopic portion is in the second position.

6. A collapsible lantern, comprising:

a base;

an inner telescopic portion movable, relative to the base, between a first, collapsed position and a second, raised position; the inner telescopic portion including a light source and a power source;

an outer telescopic portion including a cap and movable, relative to the inner telescopic portion and the base, between a first, collapsed position where the light source is covered by the cap and a second, raised position where the cap is spaced above the light source; and the outer telescopic portion further movable together with the inner telescopic portion, relative to the base, from the second position to a third, uppermost position; and a switch electrically connected between the light source and the power source; wherein the switch is off until the outer telescopic portion reaches the third position;

wherein the outer telescopic portion further comprises a reflector attached to the bottom of the cap and facing the light source so as to direct light emitted from the light source laterally out of the collapsible lantern.

7. The collapsible lantern of claim 6, wherein the light source includes a light emitting diode chip and a reflective cup mounted above the light emitting diode to direct light emitted from the light emitting diode chip toward the reflector spaced above the reflective cup.

8. A collapsible lantern, comprising:

a base;

an inner telescopic portion movable, relative to the base, between a first, collapsed position and a second, raised position; the inner telescopic portion including a light source and a power source;

an outer telescopic portion including a cap and movable, relative to the inner telescopic portion and the base, between a first, collapsed position where the light source is covered by the cap and a second, raised position where the cap is spaced above the light source; and the outer telescopic portion further movable together with the inner telescopic portion, relative to the base, from the second position to a third, uppermost position;

a switch electrically connected between the light source and the power source; wherein the switch is off until the outer telescopic portion reaches the third position; and a magnet mounted on the base, wherein the switch is a reed switch mounted on the inner telescopic portion as such that when the outer telescopic portion reaches the third, topmost position where the inner telescopic portion is in the second, raised position, the switch comes to be in close proximity to the magnet to turn the switch on.

* * * * *